US010442593B2

(12) United States Patent
Jowett et al.

(10) Patent No.: US 10,442,593 B2
(45) Date of Patent: Oct. 15, 2019

(54) LOAD CAP

(71) Applicant: LOADHOG LIMITED, South Yorkshire (GB)

(72) Inventors: Leigh Jowett, South Yorkshire (GB); John Butterworth, South Yorkshire (GB); Martin Leslie Baker, South Yorkshire (GB)

(73) Assignee: LOADHOG LIMITED (GB)

( * ) Notice: Subject to any disclaimer, the term of this patent is extended or adjusted under 35 U.S.C. 154(b) by 147 days.

(21) Appl. No.: 15/504,603

(22) PCT Filed: Sep. 2, 2015

(86) PCT No.: PCT/GB2015/000262
§ 371 (c)(1),
(2) Date: Feb. 16, 2017

(87) PCT Pub. No.: WO2016/034837
PCT Pub. Date: Mar. 10, 2016

(65) Prior Publication Data

US 2018/0222648 A1 Aug. 9, 2018

(30) Foreign Application Priority Data

Sep. 3, 2014 (GB) ..... 1415588.1
Feb. 26, 2015 (GB) ..... 1503240.2
Sep. 1, 2015 (GB) ..... 1515491.7

(51) Int. Cl.
*B65D 57/00* (2006.01)
*B65D 71/00* (2006.01)

(52) U.S. Cl.
CPC ..... *B65D 57/00* (2013.01); *B65D 71/0088* (2013.01); *B65D 2571/00055* (2013.01)

(58) Field of Classification Search
CPC ..... B65D 19/00; B65D 71/70; B32B 3/02
USPC ..... 206/427; 108/51, 58, 57.16
See application file for complete search history.

(56) References Cited

U.S. PATENT DOCUMENTS 3,951,078 A 4/1976 Fowler et al.
4,615,443 A * 10/1986 Deffner ..... B65D 85/62 206/427
2008/0022905 A1* 1/2008 Trickett ..... B65D 19/36 108/57.16

FOREIGN PATENT DOCUMENTS

| | | |
|---|---|---|
| BR | 8606283 | 7/1988 |
| DE | 1560079 | 3/1971 |
| DE | 19824255 | 12/1999 |
| GB | 2420773 | 6/2006 |
| WO | 2014114901 | 7/2014 |

* cited by examiner

*Primary Examiner* — Anthony D Stashick
*Assistant Examiner* — Raven Collins
(74) *Attorney, Agent, or Firm* — Clark Hill PLC; James R. Foley

(57) ABSTRACT

A load cap (10) comprises a central portion (12) having an edge (14), and a rim arrangement (16) on the edge. The rim arrangement comprises a plurality of corrugations (20) extending substantially parallel to the edge.

18 Claims, 9 Drawing Sheets

LOAD CAP

This invention relates to load caps. More particularly, but not exclusively, this invention relates to load caps for use with loads comprising a plurality of stacked articles, such as bottles arranged in an upright position.

Bottles are often transported in stacks on pallets. The bottles are disposed in layers on a pallet and a sheet can be arranged on the upper layer to stabilise it. However, when the pallet is wrapped in a shroud, the sheet can deform and, thereby, do not engage all the bottles in the upper layer, and do not retain the upper layer of bottles. Also, the step of wrapping the shroud around the stack can destabilise the uppermost layer of bottles. This can result in the bottles falling when the shroud is removed.

According to one aspect of this invention, there is provided a load cap comprising a central portion having an edge, and a rim arrangement on the edge, wherein the rim arrangement comprises a plurality of corrugations extending substantially parallel to the edge.

In the embodiments described herein, the rim arrangement of the load cap provides improved stabilisation of the outer articles of the load.

The corrugations may comprise wave formations, which may be substantially symmetrical waves. The wave formations may be sinusoidal.

The central portion may have a plurality of edges. The rim arrangement may comprise a plurality of rim portions. Each rim portion may extend from one of the edges. Each rim portion may be attached to one of the edges.

Each rim portion may comprise a plurality of the corrugations extending substantially parallel to the edge of the central portion to which the rim portion is attached.

The rim arrangement may comprise a main member having the corrugations. The rim arrangement may comprise a lip arrangement extending outwardly from the main member. The lip arrangement may comprise a plurality of lip members. A respective lip member may be provided on each rim portion.

The lip arrangement may extend downwardly from the main member. The lip arrangement may extend below the main member.

The central portion may have a thickness, and the wave formations may have a height, the height of the wave formations being greater than the thickness of the central portion. The height of the wave formations may be substantially the same as each other.

The load cap may be suitable for capping a load comprising a plurality of articles stacked upon one another.

The rim arrangement may be deformable around the articles at the edges of the central portion. The load may comprise a single layer or a plurality of layers. Where the load comprises a plurality of layers, each layer constitutes an intermediate load. The load cap may be arrangeable on one or more of the intermediate loads, thereby capping the respective intermediate load.

The articles may comprise bottles, which may be stacked in an upright position. Each of the bottles may have a top portion. It is desirable that the outermost bottles on the, or each, layer may have the top portions thereof disposed wholly beneath the corrugations, or overlapping the corrugations and the central portion.

The corrugations may have a pitch, the pitch being the distance between a point on one corrugation and the corresponding point on the adjacent corrugation. The pitch of the corrugations may be selected so that the corrugations can grip the articles therebetween.

The central portion may have a corner and the rim arrangement may include corner formations that extend around the corners. Each corner formation may comprise a deformation facilitation formation at said corner of the central portion to allow the rim arrangement to deform around articles at said corner. The central portion may have a plurality of corners and the rim arrangement may comprise a plurality of corner formations extending around the corners. The, or each, corner formation has a respective deformation facilitation formation to allow the rim arrangement to deform around the articles at each corner.

The, or each, deformation facilitation formation may be a gap defined in the corner formation to allow the aforesaid deformation of the rim arrangement at said corner. The, or each, gap may be in the form of a slot.

Alternatively, the, or each, deformation facilitation formation may be a web provided in the corner formation to allow the aforesaid deformation of the rim arrangement at said corner. The, or each, corner formation may include a main corner member The, or each, corner formation may have a free edge, which may be curved. The, or each, deformation facilitation formation may extend inwardly across the corner formation. The, or each, deformation facilitation formation may be in the form of a slot extending inwardly from the free edge of the corner formation. Alternatively, the, or each, deformation facilitation formation may comprise a strip of an elastomeric material extending inwardly from the free edge of the corner formation.

Each corner formation may include a main corner member having a plurality of corner wave formations, at least some of which may extend on opposite sides of the gap. Each corner formation may include a corner lip arrangement extending downwardly from the main corner member. The, or each, corner lip arrangement may comprise first and second corner lip portions on opposite sides of the gap.

Each wave formation may extend substantially the whole length of the edge of the central portion from which the respective rim portion extends. The wave formations may be substantially identical to each other. If desired, the strip of the elastomeric material may be configured to have wave formations. Alternatively, the strip of the elastomeric material may be substantially devoid of the wave formations.

At least one embodiment of the invention will now be described with reference to the accompanying drawings, in which.

Figure 1:
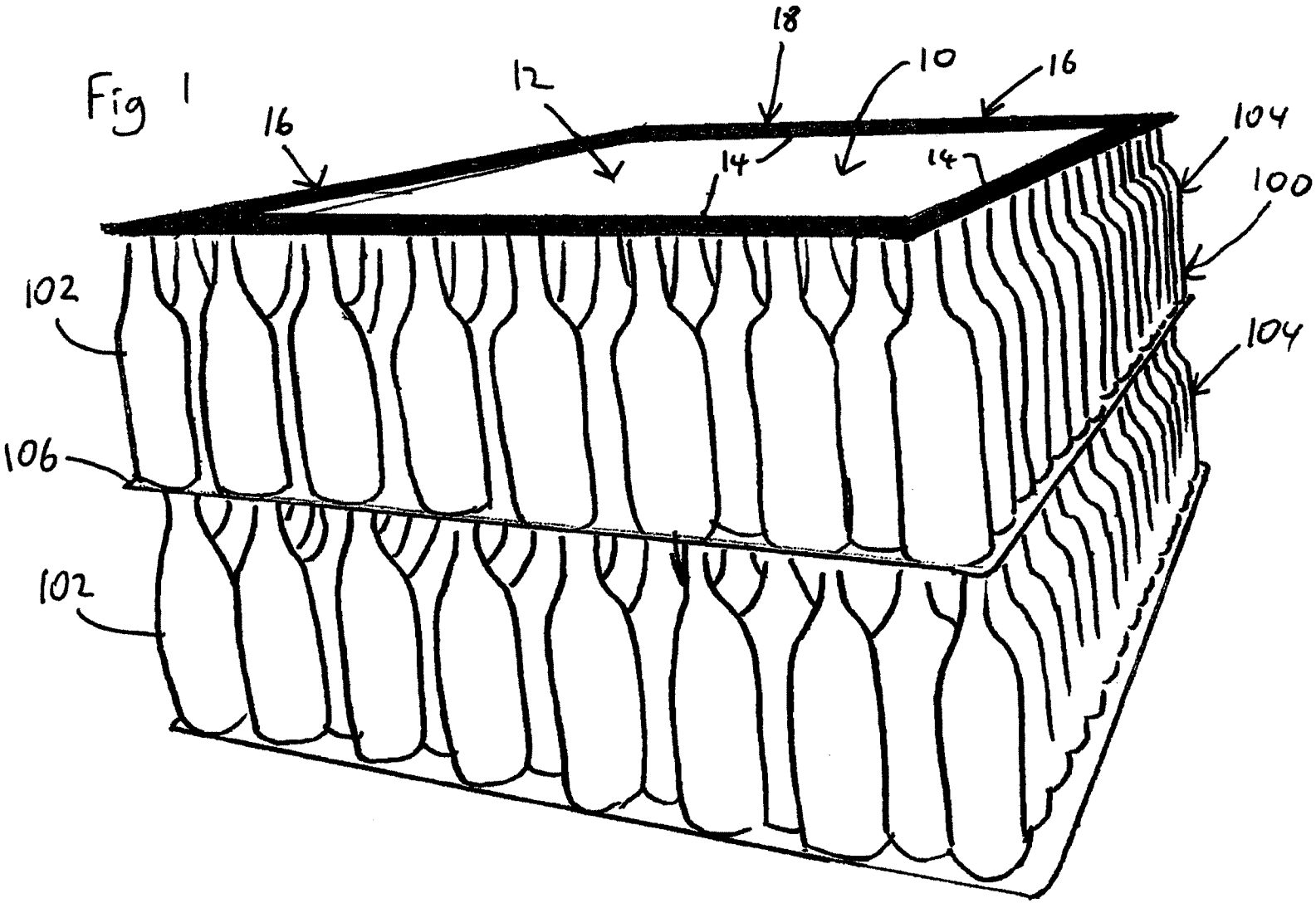
FIG. 1 is a perspective view of a load cap comprising a plurality of articles with a load cap thereon.

Referring to FIG. 1, a load cap 10 is shown disposed on a load 100 comprising a plurality of stacked articles, in the form of bottles 102. The stack of the bottles 102 is arranged on a pallet (not shown) in layers 104, where each layer 104 is separated from the one below by a slip sheet 106. The purpose of the load cap 10 is to stabilise the load 100 during transport, for example on conveyor belts. The load cap 10 is arranged on the upper layer 104.

The load cap 10 is generally rectangular in configuration and comprises a substantially planar central portion 12 formed of a rigid plastics material. The central portion has a plurality of edges 14 extending therearound. A rim arrangement 16 is attached to the central portion 12 at the edges 14.

Figure 2:
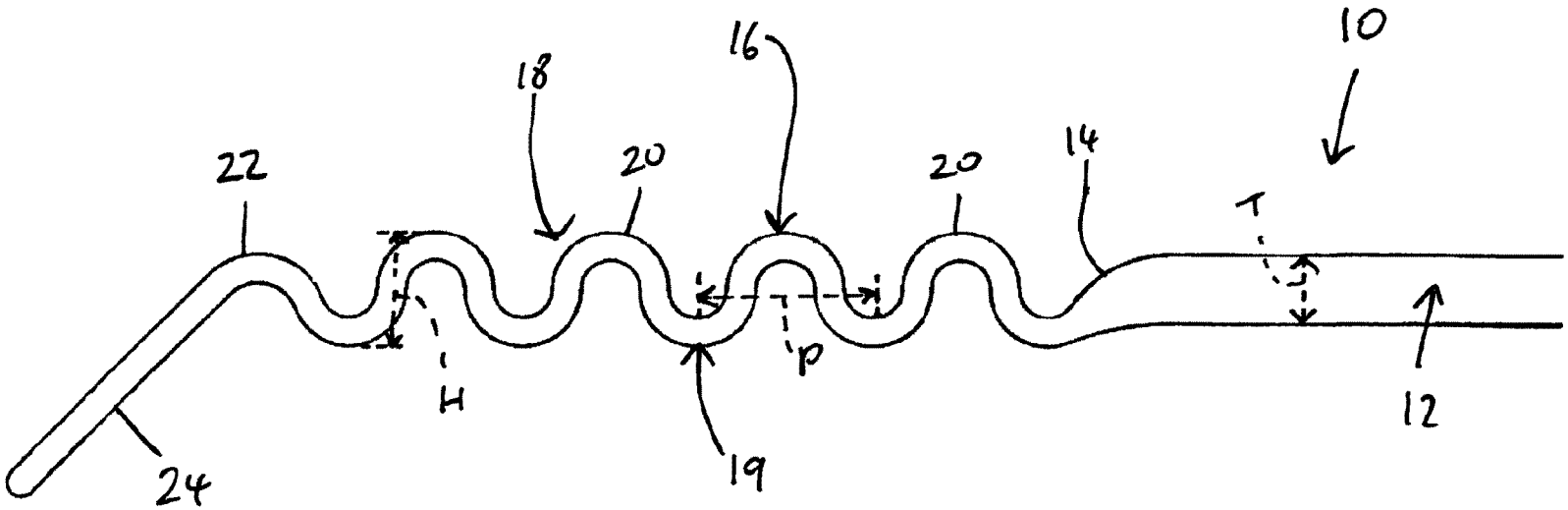
FIG. 2 is sectional view through an edge region of the load cap, showing a rim portion.
Figure 3:
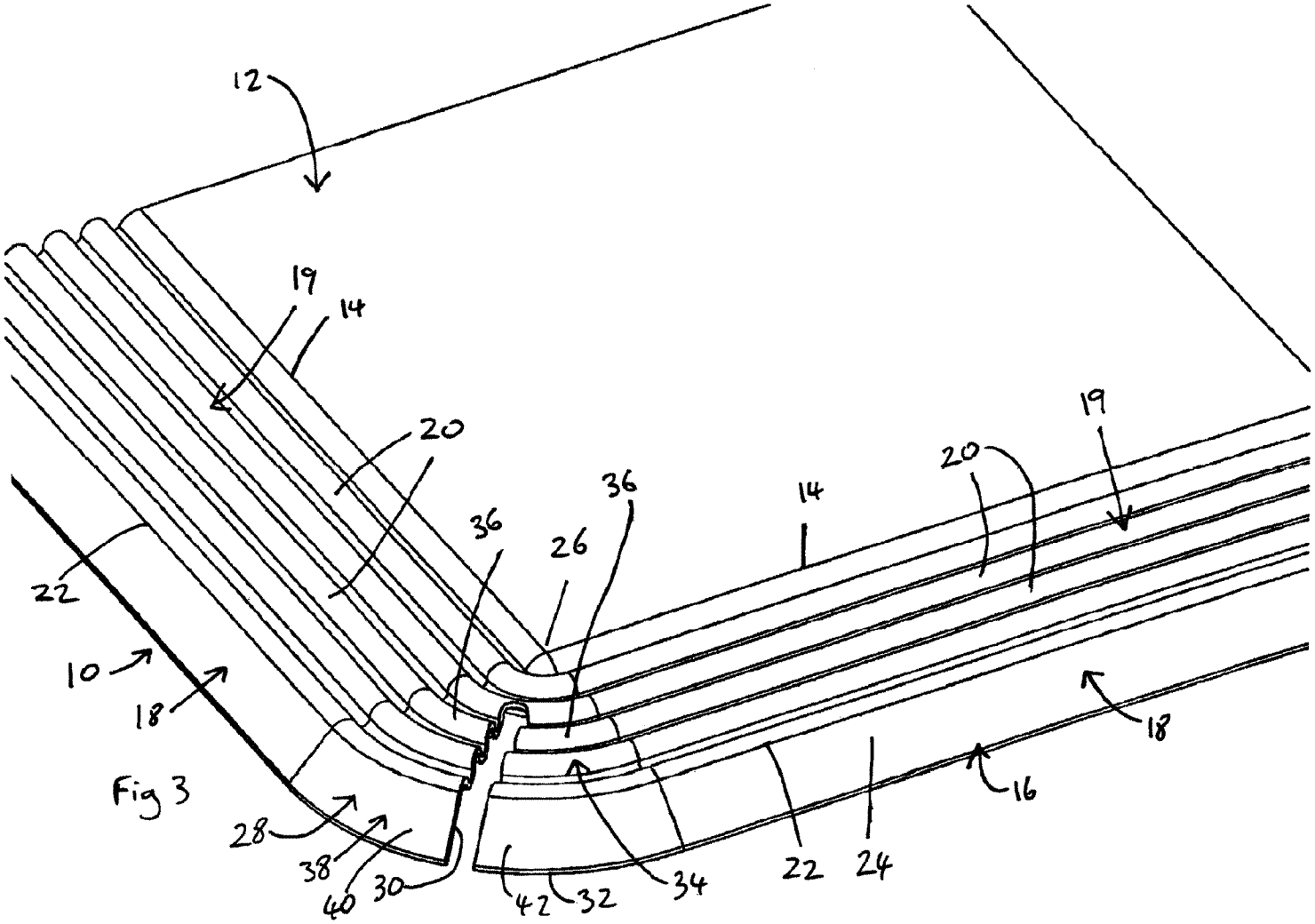
FIG. 3 is a perspective view of a corner formation of the load cap.

The rim arrangement 16 comprises a plurality of elongate rim portions 18, each being attached to a respective one of the edges 14 of the central portion 12. The rim arrangement 16 is shown generally in FIG. 1, but it is shown in more detail in FIGS. 2 to 4.

Figure 4:
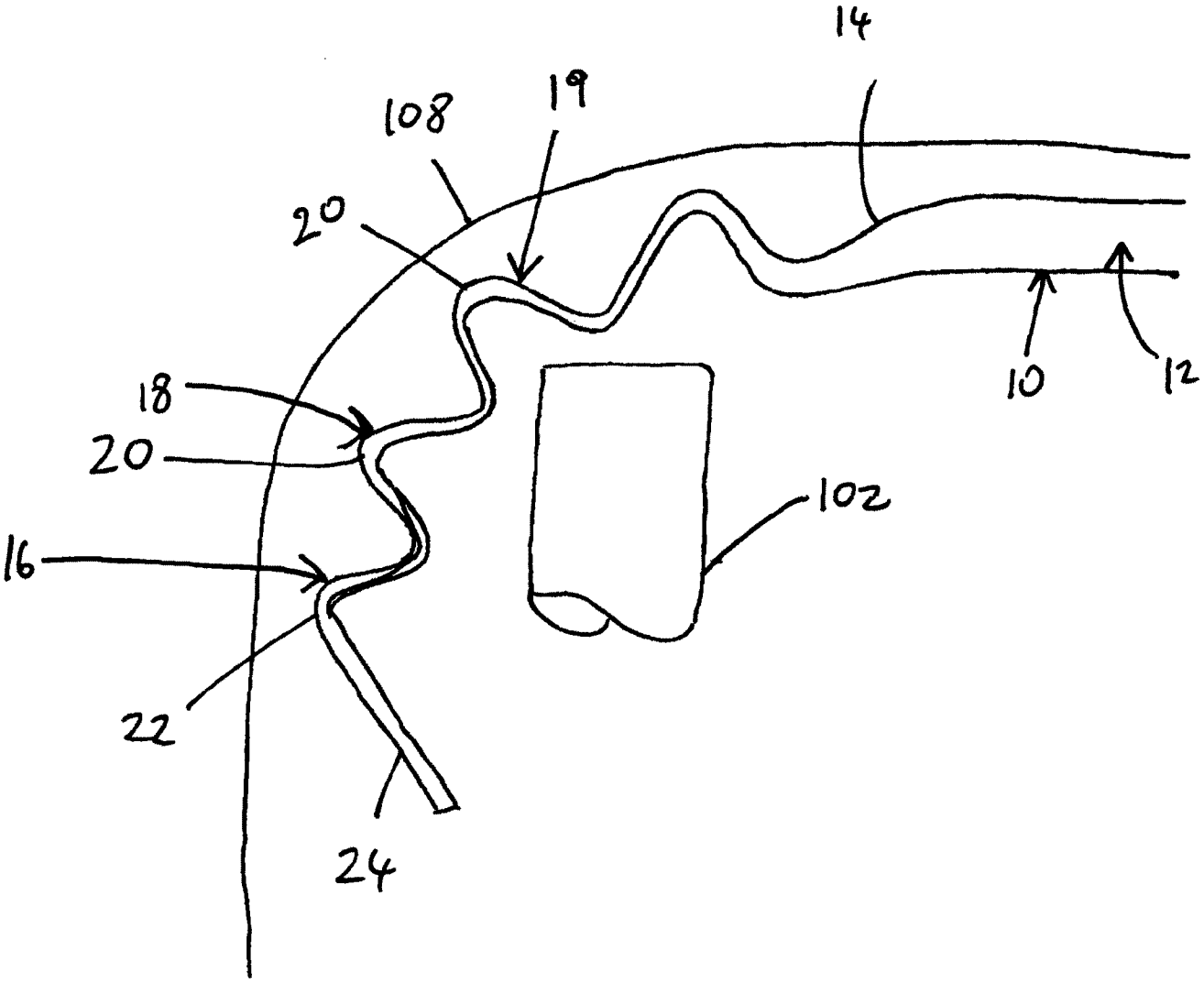
FIG. 4 is sectional view through an edge region of a load cap, showing the load cap in use.

In the embodiment shown in FIG. 1, each rim portion 18 extends along the edge 14 to which it is attached. The rim portions 18 are deformable around the bottles 102 at the edge of the upper layer 104 of the load 100. FIG. 4 shows an example of the rim portion 18 deformed downwardly around the top of one of the outermost bottles 102.

The rim portions 18 are formed of a suitable plastics material. The central portion 12 is also formed of the plastics material. Alternatively, the load cap 10 can be formed of cardboard, or other suitable material, in situations where the load cap 10 is intended to be disposable.

When the load cap 10 is disposed on the upper layer 104 of the bottles 102, it extends across the whole of the top layer 104 and its weight acts to stabilise the bottles 102. The rim portion 18 extends beyond the outermost bottles 102 and serves to retain them in position.

The load 100 may have a wrapping 108 (see FIG. 4), in the form of a shroud, applied thereto, for example to secure the bottles 102 in the load 100. When the wrapping 108 is applied, it deforms the rim portions 18 so that the rim portions 18 extend downwardly around the tops of the bottles 102. This prevents the outermost bottles 102 of the upper layer 104 from being pushed off the pallet as the wrapping 108 is applied.

In a prior method, when the wrapping 108 is applied to the load 100, the tops of the outermost bottles 102 on the upper layer 104 are pushed inwardly. On removal of the wrapping 108, there is a tendency for the outermost bottles 102 on the upper layer 104 to fall. The embodiment of the present invention described herein provides the advantage that the rim portions 16 hold the outermost bottles 102 of the upper layer and prevent them from being pushed inwardly by the wrapping step. As a result there is less breakage of the bottles 102.

Each of the rim portions 18 comprises a main member 19. The main member 19 comprises a plurality of corrugations in the form of wave formations 20. In the embodiment shown in FIG. 2, the rim portion 18 comprises four of the wave formations 20, but it will be appreciated that the rim portion 18 could comprise any other suitable number of wave formations 20. The wave formations 20 act like a spring and reduce stress in the load cap 10 when the wave formations are deformed around the outer bottles 102 of the load 100.

The wave formations are substantially identical to each other and have a height H, the height H being substantially uniform. The central portion 12 has a thickness T. As can be seen from FIG. 2, the height H is greater than the thickness T. This has the effect in the embodiment described herein that the reduction in stress is maximised.

The wave formations 20 have a pitch P, which is the distance between a point on one wave formation 20 and the corresponding point on the adjacent wave formation 20. The pitch of the wave formations 20 is selected so that the wave formations 20 can grip the bottles 102 therebetween. Thus, in the use of the embodiment described herein, the outermost edges of the lips of the tops of the bottles 102 are located in the troughs of the wave formations 20.

The main member 19 of each rim portion 18 has an outer edge 22. Each rim portion 18 also includes a lip member 24 attached to the outer edge 22 of the main member 19. The lip member 24 is elongate and comprises a substantially planar member. The lip member 24 extends substantially parallel to the edge 14 to which the respective rim portion 18 is attached.

The wave formations 20 are sinusoidal and substantially symmetrical. The wave formations 20 extend substantially parallel to the edge 14 to which the respective rim portion 18 is attached.

In the embodiment described herein, the wave formations 20 provide the advantage that the main portion 19 can be deformed around the tops of the outer bottles 102 when the wrapping 108 is applied around the load 100, as shown in FIG. 4. As can be seen in FIG. 4, the top of the bottle 102 is wholly within the region defined by the wave formations 20.

Each wave formation 20 extends substantially the whole length of the edge 14 of the central portion 12 to which the respective rim portion 18 is attached.

The central portion 12 has a plurality of corners 26. In the embodiment shown, in which the load cap 10 is substantially rectangular, the central portion 12 has four corners 26. The rim arrangement 16 has corner formations 28 that extend around the corners 26

Each corner formation 28 defines a gap 30 to allow the rim arrangement 16 to deform around articles at said corner 26. Each corner formation 28 has a convexly curved free edge 32. The gap 30 is in the form of a slot extending inwardly from the free edge 32.

Each corner formation 28 includes a main corner member 34. Each main corner member 34 may have a plurality of corner wave formations 36, at least some of which may extend on opposite sides of the gap 30. Each corner formation 28 also includes a corner lip arrangement 38 extending downwardly from the main corner member 34. The corner lip arrangement 38 comprises first and second corner lip portions 40, 42 on opposite sides of the gap 30.

There is thus described a load cap, the preferred embodiment of which is suitable for stabilising a stack of bottles on a pallet. The provision of rim portions 18 having wave formations 20 extending parallel to the edge 14 to which the respective rim portions 18 are attached provides the advantage in the embodiment described herein that the whole of the stack of bottles 100 is stabilised.

Figure 5:
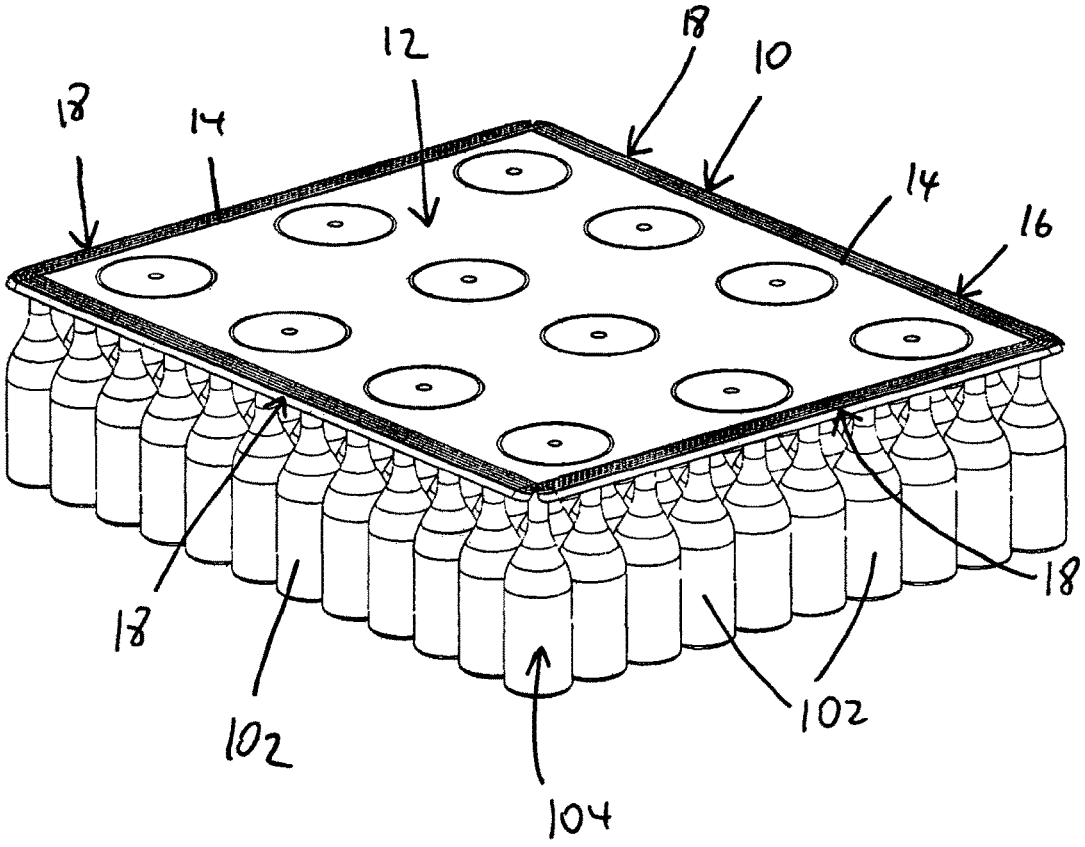
FIG. 5 shows the load cap on a first layer of a load comprising a plurality of layers.
Figure 6:
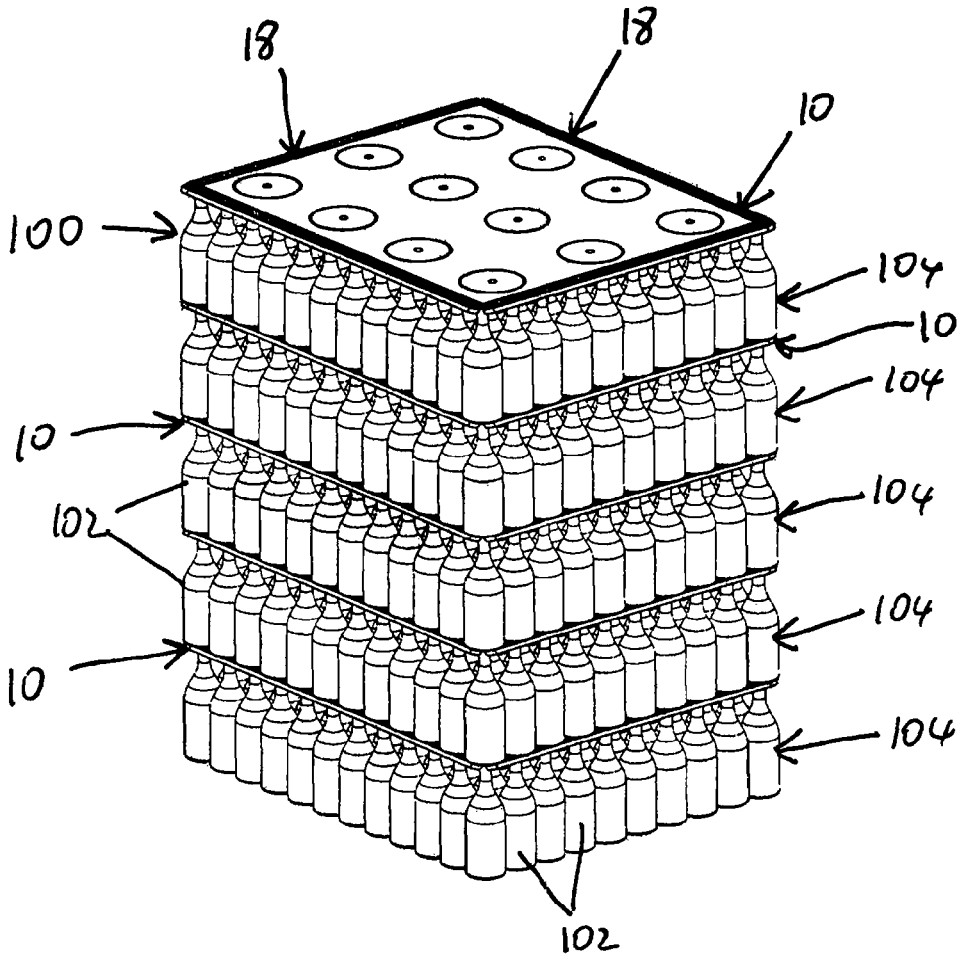
FIG. 6 is a perspective view of a load comprising a plurality of layers, a respective load cap being arranged on each layer.
Figure 7:
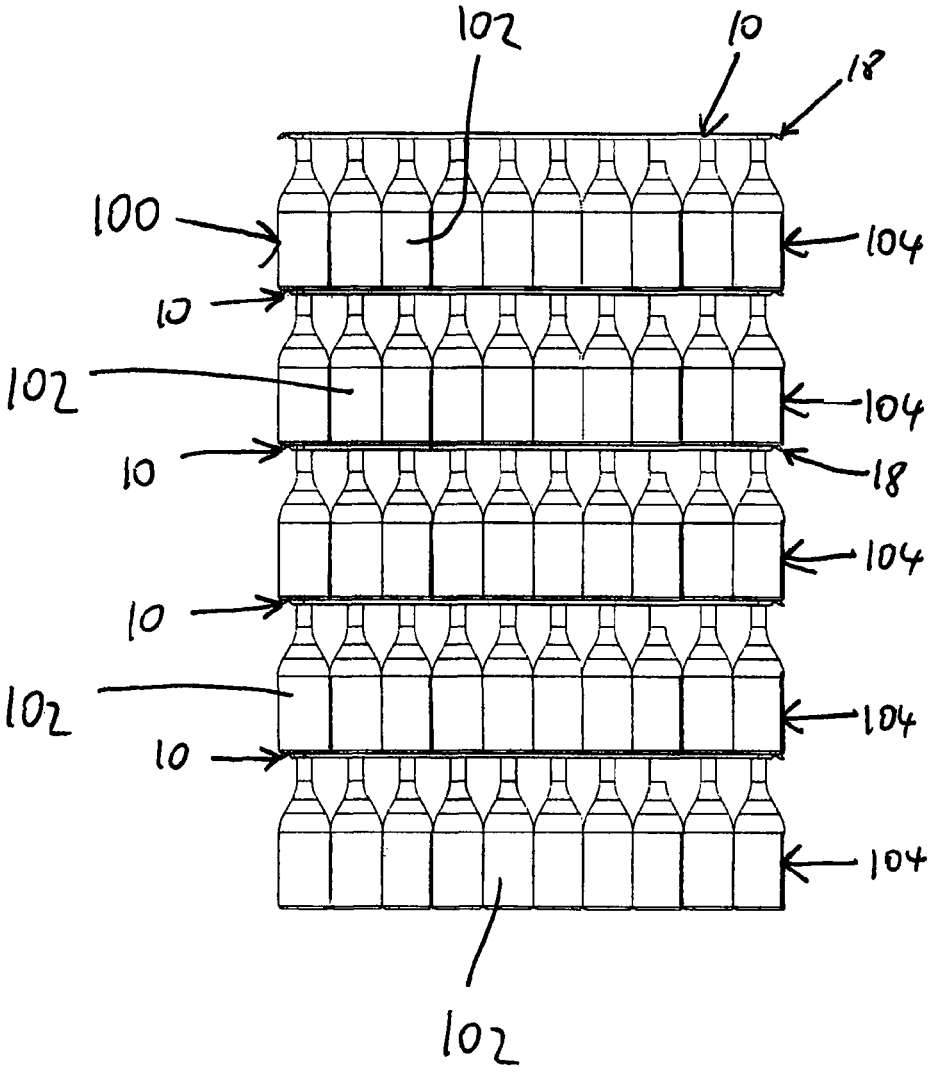
FIG. 7 is a side view of the load shown in FIG. 6.

FIGS. 5, 6 and 7 show load caps 10 arranged on each layer of a load 100 comprising a plurality of layers 104. Each layer 104 constitutes an intermediate load and comprises a plurality of articles in the form of bottles 102.

In FIGS. 5 to 7, one of the load caps 10 is arranged on the upper layer 104, and further load caps 10 are arranged on each of the layers 104 beneath the upper layer 104, in place of the slip sheets 106 described above. FIG. 5 shows the load cap 10 arranged on the lower layer 104, and FIGS. 6 and 7 show the load caps 10 arranged on each of the layers 104.

The arrangement of the load caps 10 on each of the layers 104 provides the advantage that the outermost bottles 102 of each layer 104 are protected by the rim portions 18 of the respective load cap 10 thereon. The wrapping 108 (not shown in FIGS. 5 to 7) is applied around the load 100, and deforms the rim portions 18 of each load cap 10 to extend downwardly around the tops of the bottles 102. Thus, where a respective load cap 10 is used on each layer 104, the outermost bottles 102 are prevented from being dislodged as the wrapping 108 is applied.

Various modifications can be made without departing from the scope of the invention. For example, the number of wave formations in each rim portion can vary.

Figure 8:
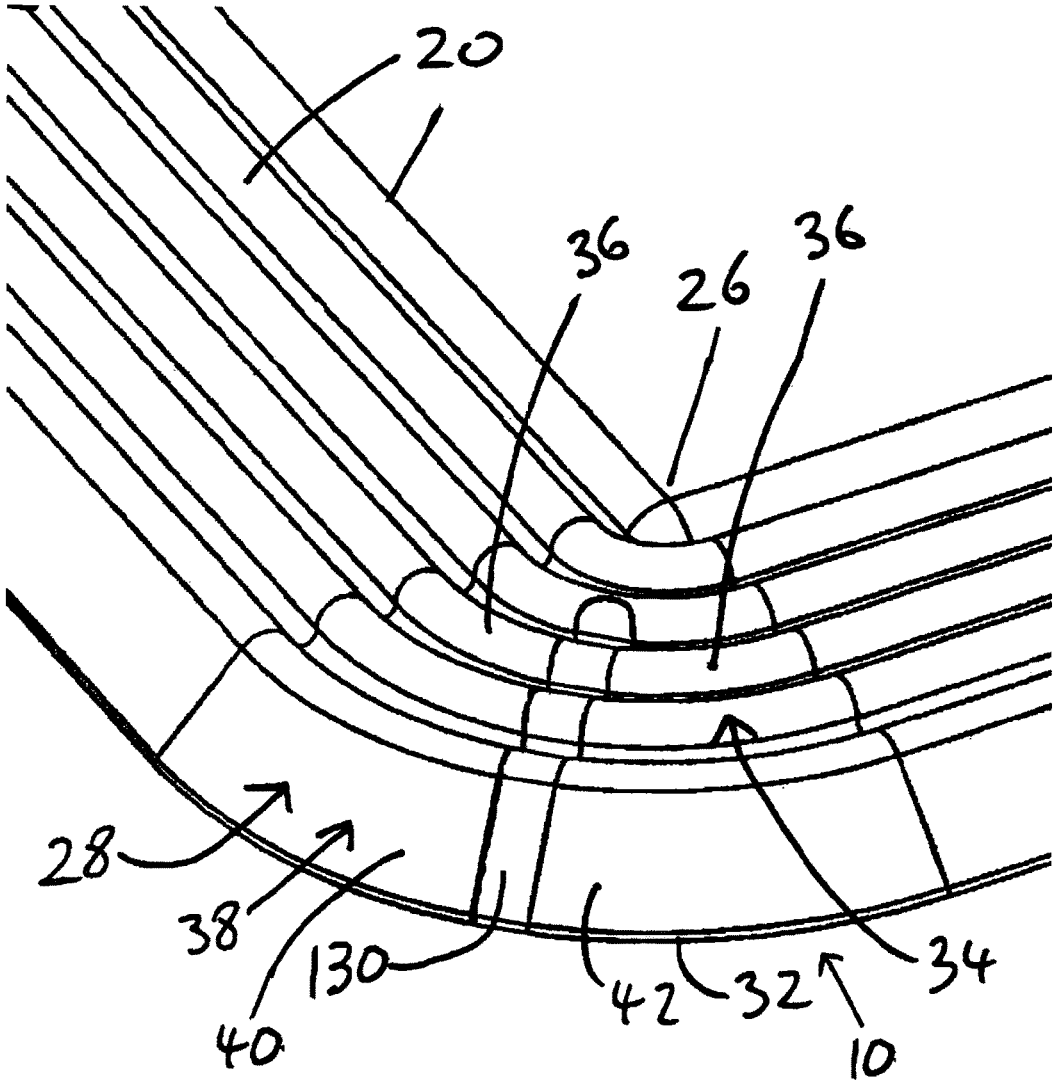
FIG. 8 shows a corner formation of another embodiment of a load cap.

A second embodiment is shown in FIG. 8, which comprises many of the features of the embodiment shown in FIGS. 1 to 7, and those features have been designated with the same reference numbers as the corresponding features in FIGS. 1 to 6. FIG. 8 shows a corner formation 28 of the second embodiment of the load cap 10.

The corner formations 28 shown in FIG. 8 include a web portion 130 which extends inwardly from the free edge 32. The web portions 130 may be provided with the same wave formations 36 as the corner formations 28. The web portion 130 is in the form of a thin strip of a resiliently deformable material, such as an elastomeric material. The elastomeric material allows the corner formations 28 to deform and wrap individually around the corner articles of the load.

Figure 9:
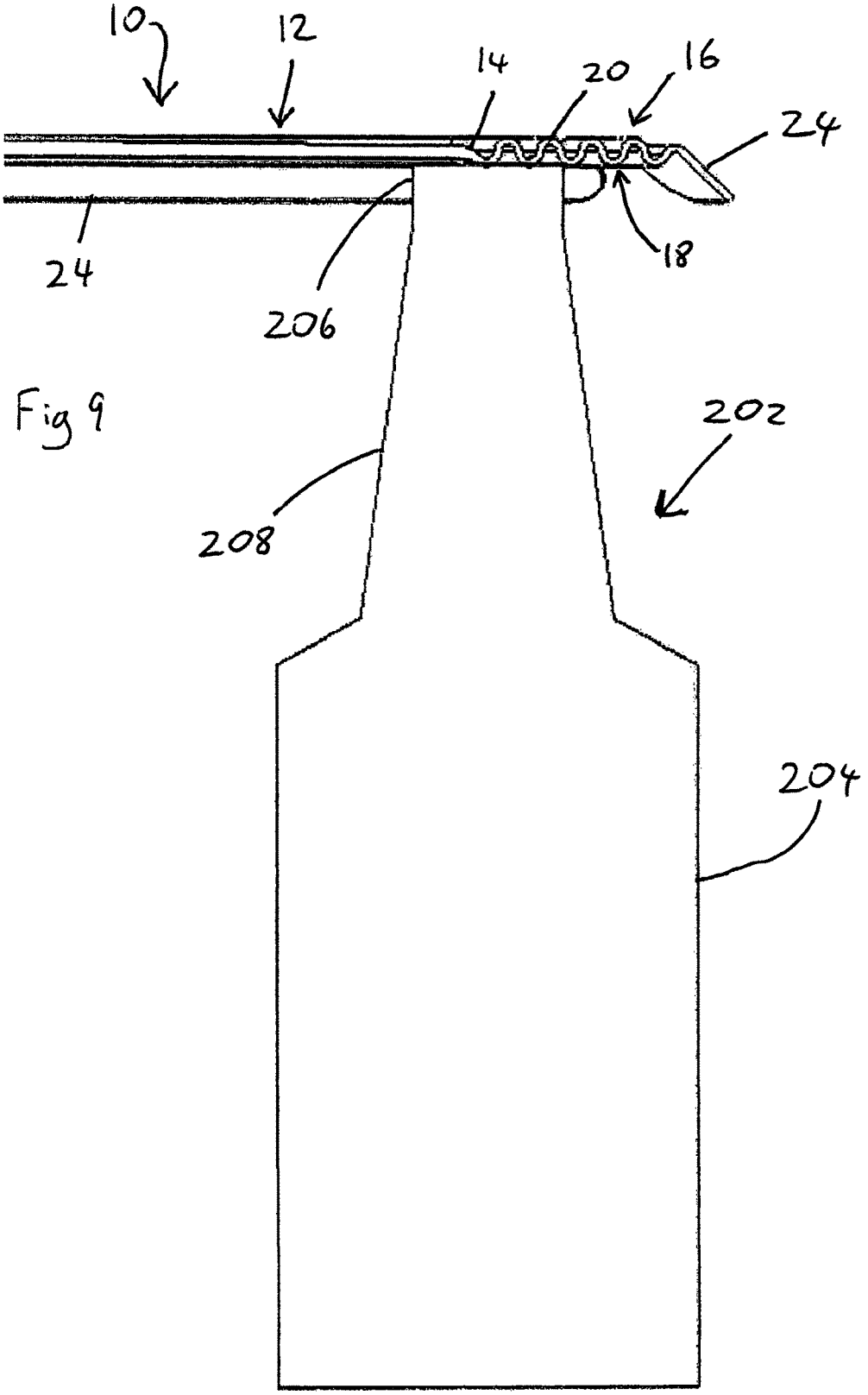
FIG. 9 is a sectional view of the load cap having a rim portion and a central portion, showing an outermost bottle overlapping the rim portion and the central portion of the load cap.

FIG. 9 shows a further sectional view of a rim portion 18 and a bottle 202 having a main part 204 and a top portion 206 and a neck portion 208 between the top portion and the main part. The main part 204 has a diameter of a size that disposes the top portions 206 of the outermost bottles 204 further away from the lip member 24 than the top portions of the bottles 102 shown in FIG. 4.

In FIG. 9, the top portion 206 overlaps the wave formations 20 of the rim portion 18 and also overlaps the central portion 12. In the embodiment shown, so long as at least some of the top portion 206 of the bottle 204 overlaps the wave formations 20, the rim portion 12 can deform around the top portions 206 of the outermost bottles 202 to hold them in place.

The invention claimed is:

1. A load cap comprising a central portion having an inner edge, and a rim arrangement on the inner edge, the rim arrangement having an outer edge, wherein the rim arrangement comprises a plurality of corrugations, each corrugation extending substantially parallel to the inner edge, and wherein the corrugations are curved wave formations, the curvature of the wave formations being continuous across the rim arrangement from the inner edge to the outer edge; the central portion having a thickness and the corrugations having a height, the height of the corrugations being greater than the thickness of the central portion, wherein the central portion has a plurality of inner edges, and the rim arrangement comprises a plurality of rim portions, each rim portion extending from a respective one of the inner edges, and each rim portion comprises a plurality of the corrugations extending substantially parallel to the inner edge of the central portion to which the rim portion is attached.

2. A load cap according to claim 1, wherein the wave formations are substantially symmetrical waves.

3. A load cap according to claim 1, wherein the rim arrangement comprises a main member having the corrugations, and the rim arrangement further includes a lip arrangement extending outwardly from the main member.

4. A load cap according to claim 1, wherein the rim arrangement comprises a lip arrangement extending outwardly from the main member, the lip arrangement comprising a plurality of lip members, a respective lip member being provided on each rim portion.

5. A load cap according to claim 4, wherein the lip arrangement extends downwardly from the main member.

6. A load cap according to claim 1, wherein the height of the corrugations is substantially uniform.

7. A load cap according to claim 1, wherein the central portion has a corner and the rim arrangement includes a corner formation that extends around the corner, the corner formation comprising a deformation facilitation formation at said corner of the central portion to allow the rim arrangement to deform around articles at said corner.

8. A load cap according to claim 7, wherein the central portion has a plurality of corners and the rim arrangement comprises a plurality of said corner formations, each corner formation extending around a respective one of the corners.

9. A load cap according to claim 7, wherein each corner formation has a respective deformation facilitation formation to allow the rim arrangement to deform around the articles at each corner.

10. A load cap according to claim 7, wherein the, or each, deformation facilitation formation is a gap defined in the corner formation to allow the aforesaid deformation of the rim arrangement at said corner.

11. A load cap according to claim 7, wherein the, or each, deformation facilitation formation is a web provided in the corner formation to allow the aforesaid deformation of the rim arrangement at said corner.

12. A load cap according to claim 11, wherein the, or each, web comprises a strip of an elastomeric material.

13. A load cap according to claim 7, wherein the, or each, corner formation has a curved free edge and the, or each, deformation facilitation formation extends inwardly from the free edge of the corner formation.

14. A load cap according to claim 7, wherein the, or each, deformation facilitation formation extends inwardly across the corner formation.

15. A load cap according to claim 7, wherein the, or each, corner formation includes a main corner member having a plurality of corner wave formations.

16. A load cap according to claim 15, wherein the, or each, corner formation includes a corner lip arrangement extending downwardly from the main corner member.

17. A load cap according to claim 16, wherein the, or each, corner lip arrangement comprises first and second corner lip portions on opposite sides of the gap.

18. A load cap according to claim 1, wherein the, or each, corrugation extends substantially the whole length of the, or each, inner edge of the central portion from which the respective rim portion extends.

* * * * *